US009958130B2

(12) United States Patent
Hino et al.

(10) Patent No.: US 9,958,130 B2
(45) Date of Patent: May 1, 2018

(54) VEHICLE LIGHTING DEVICE, VEHICLE LAMP, AND METHOD OF MANUFACTURING VEHICLE LIGHTING DEVICE

(71) Applicant: Toshiba Lighting & Technology Corporation, Yokosuka-shi, Kanagawa-ken (JP)

(72) Inventors: Kiyokazu Hino, Yokosuka (JP); Toshihiro Hatanaka, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days. days.

(21) Appl. No.: 15/270,050

(22) Filed: Sep. 20, 2016

(65) Prior Publication Data

US 2017/0097136 A1 Apr. 6, 2017

(30) Foreign Application Priority Data

Oct. 2, 2015 (JP) ..... 2015-196805
Nov. 13, 2015 (JP) ..... 2015-222708
Nov. 19, 2015 (JP) ..... 2015-226550

(51) Int. Cl.
*F21S 8/10* (2006.01)
*F21V 29/76* (2015.01)
(Continued)

(52) U.S. Cl.
CPC ..... *F21S 48/328* (2013.01); *F21S 43/14* (2018.01); *F21S 43/195* (2018.01); *F21S 45/47* (2018.01);
(Continued)

(58) Field of Classification Search
CPC ..... F21S 48/328; F21S 48/321; F21S 48/33; F21V 29/767; F21V 29/89; F21V 23/06; F21V 31/005
(Continued)

(56) References Cited

U.S. PATENT DOCUMENTS 7,621,667 B2 * 11/2009 Behr ..... F21S 48/1109 362/294
7,806,562 B2 * 10/2010 Behr ..... F21K 9/00 362/294
(Continued)

FOREIGN PATENT DOCUMENTS

JP 2013-025935 A 2/2013

*Primary Examiner* — Laura Tso
(74) *Attorney, Agent, or Firm* — Banner & Witcoff, Ltd.

(57) ABSTRACT

A vehicle lighting device includes a heat radiating portion that has a flange having a plate shape, heat radiating fins provided on one surface of the flange, and a loading portion provided on a surface of the flange on a side opposite to the side on which the heat radiating fins are provided. The device further includes a storage portion that is provided on a side of the flange opposite to the side on which the heat radiating fins are provided, has a mounting portion surrounding the loading portion and bayonets provided on a side surface of the mounting portion, and is formed of a material different from a material of the heat radiating portion. Also, the device includes a light emitting module that is provided on an end surface of the loading portion on a side opposite to the flange side and has a light emitting element.

18 Claims, 7 Drawing Sheets

(51) Int. Cl.

| | |
|---|---|
| ***F21V 29/89*** | (2015.01) |
| *F21V 23/06* | (2006.01) |
| *F21V 31/00* | (2006.01) |

(52) U.S. Cl.
CPC ..... *F21S 45/48* (2018.01); *F21S 45/49* (2018.01); *F21S 45/50* (2018.01); *F21V 29/767* (2015.01); *F21V 29/89* (2015.01); *F21S 45/10* (2018.01); *F21V 23/06* (2013.01); *F21V 31/005* (2013.01)

(58) Field of Classification Search
USPC ..... 362/545, 651, 249.02
See application file for complete search history.

(56) References Cited

U.S. PATENT DOCUMENTS

| | | | | |
|---|---|---|---|---|
| 8,845,146 | B2 * | 9/2014 | Blankestijn | F21V 17/14 362/294 |
| 9,618,188 | B2 * | 4/2017 | Hatanaka | F21S 48/212 |
| 2012/0075880 | A1 * | 3/2012 | Hayashi | F21S 48/1109 362/547 |

* cited by examiner

VEHICLE LIGHTING DEVICE, VEHICLE LAMP, AND METHOD OF MANUFACTURING VEHICLE LIGHTING DEVICE

CROSS-REFERENCE TO RELATED APPLICATIONS

This application is based upon and claims the benefit of priority from the prior Japanese Patent Application No. 2015-196805, filed on Oct. 2, 2015; No. 2015-226550, filed on Nov. 19, 2015; No. 2015-222708, filed on Nov. 13, 2015; the entire contents of which are incorporated herein by reference.

FIELD

Embodiments described herein relate generally to a vehicle lighting device, a vehicle lamp, and a method of manufacturing a vehicle lighting device.

BACKGROUND

There is a vehicle lighting device including a socket and a light emitting module that is provided on one end side of the socket and has a light emitting diode (LED).

Heat generated in the light emitting diode is mainly discharged to the outside via the socket.

Thus, the socket is provided with heat radiating fins.

In addition, the socket is provided with a bayonet protruding outward from the vehicle lighting device and a flange. The bayonet and the flange are used when mounting the vehicle lighting device on a vehicle lamp.

In this case, it is preferable that a portion in which the heat radiating fins are provided is formed of a metal and the like in consideration of heat radiation.

Since a power supplying terminal is provided in a portion in which the bayonet is provided, it is preferable that the portion is formed of an insulating material such as a resin.

Therefore, a socket including a metallic portion having the heat radiating fins and a resin portion having the bayonet and the flange has been proposed.

Meanwhile, since the metallic portion having the heat radiating fins is surrounded by the resin portion having the bayonet and the flange, there is a problem of poor heat radiation.

Therefore, it is preferable that development of a technique capable of improving the heat radiation.

BRIEF DESCRIPTION OF THE DRAWINGS

FIG. 6A is a sectional view of a case of an annular convex portion and FIG. 6B is a sectional view of a case of a protruding convex portion.

DETAILED DESCRIPTION

Figure 1:
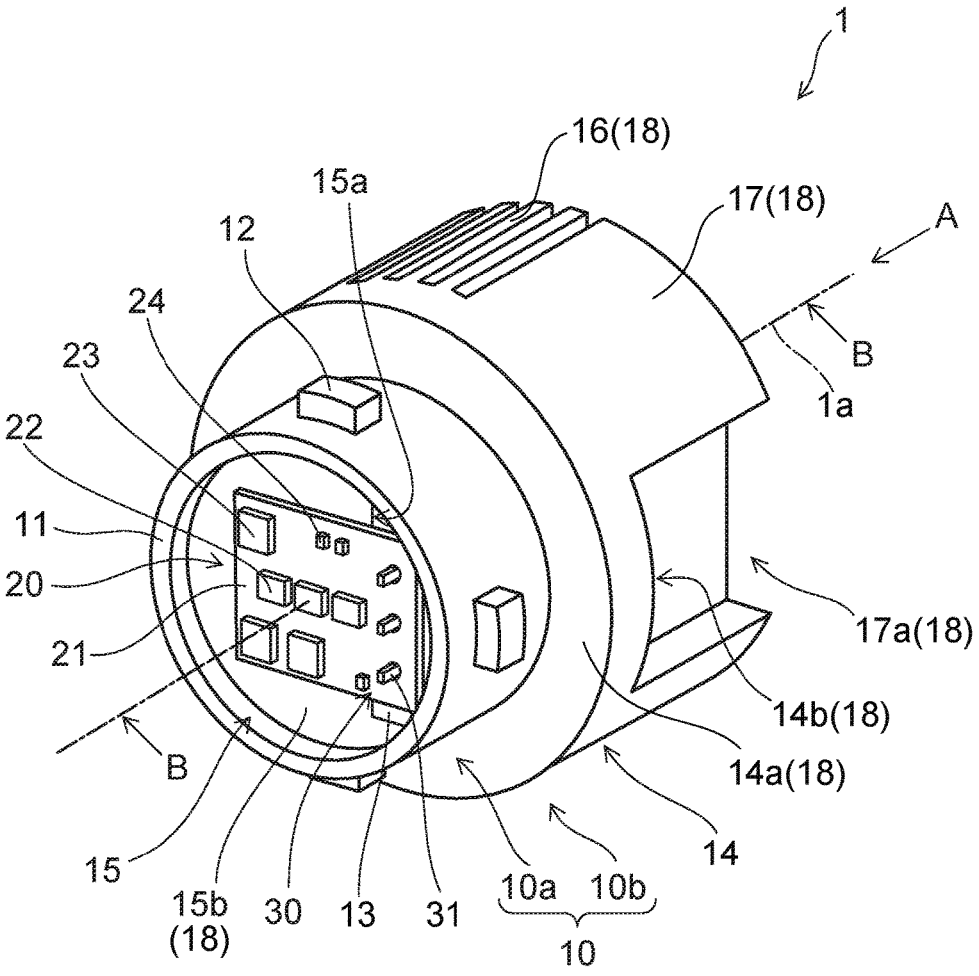
FIG. 1 is a schematic perspective view illustrating a vehicle lighting device according to an embodiment.

A vehicle lighting device according to an exemplary embodiment includes a heat radiating portion that has a flange having a plate shape, heat radiating fins provided on one surface of the flange, a loading portion provided on a surface of the flange on an side opposite to the side on which the heat radiating fins are provided; a storage portion that is provided on a side of the flange opposite to the side on which the heat radiating fins are provided, has a mounting portion surrounding the loading portion and bayonets provided on a side surface of the mounting portion, and is formed of a material different from a material of the heat radiating portion; and a light emitting module that is provided on an end surface of the loading portion on a side opposite to the flange side and has a light emitting element.

Hereinafter, exemplary embodiments will be described with reference to the drawings. Moreover, the same reference numerals are given to the same configuration elements in each drawing and detailed description will be appropriately omitted.

As a vehicle lighting device 1 of the exemplary embodiment, for example, can be provided in automobiles, railway vehicles, or the like. As the vehicle lighting device 1 provided in the automobile, for example, a front combination light (formed by appropriately combining, for example, a daytime running lamp (DRL; Daylight Running Lamp), a position lamp, a turn signal lamp, and the like), a rear combination light (formed by appropriately combining, for example, a stop lamp, a tail lamp, a turn signal lamp, a back lamp, a fog lamp, and the like), and the like can be exemplified. However, application of the vehicle lighting device 1 is not limited to the examples.

FIG. 1 is a schematic perspective view illustrating the vehicle lighting device 1 according to the embodiment.

Figure 2:
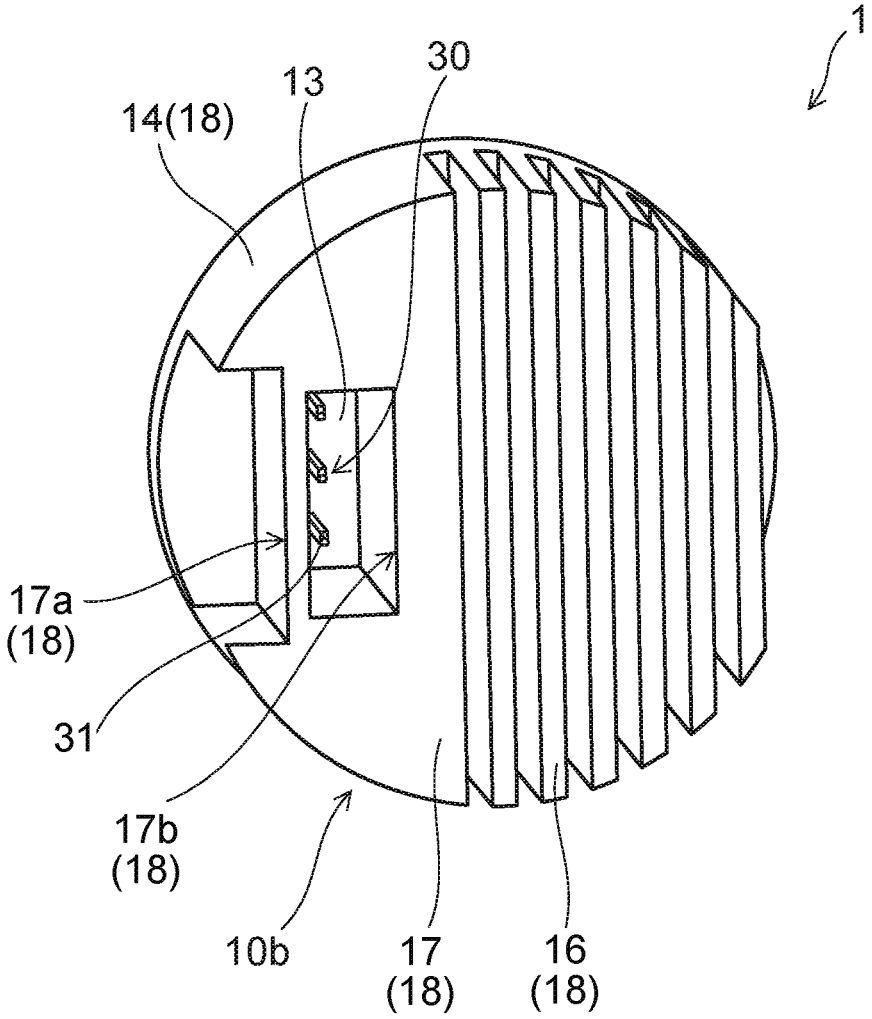
FIG. 2 is a schematic view of the vehicle lighting device viewed in a direction A in FIG. 1.

FIG. 2 is a schematic view of the vehicle lighting device 1 viewed in a direction A in FIG. 1.

Figure 3:
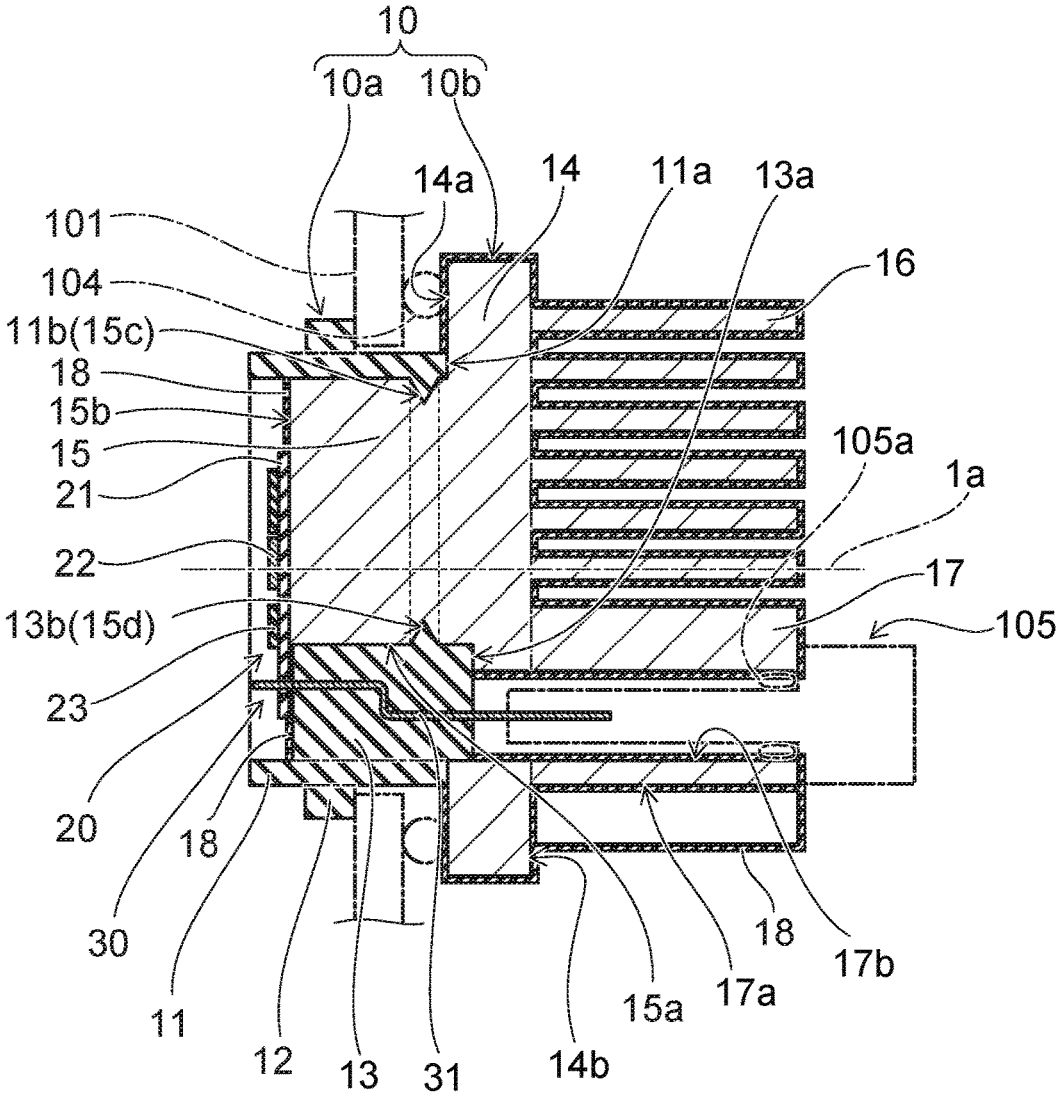
FIG. 3 is a schematic sectional view of the vehicle lighting device in a direction of line B-B in FIG. 1.

FIG. 3 is a schematic sectional view of the vehicle lighting device 1 in a direction of line B-B in FIG. 1.

FIGS. 4A to 4D are schematic sectional views illustrating a position of an end surface 11*a* of a mounting portion 11 on a flange 14 side and a position of an end surface 13*a* of an insulating portion 13 on the flange 14 side.

As illustrated in FIGS. 1, 2, and 3, the vehicle lighting device 1 is provided with a socket 10, a light emitting module 20, and a power supplying portion 30.

The socket 10 has a storage portion 10*a* and a heat radiating portion 10*b*.

The storage portion 10*a* has the mounting portion 11, a bayonet 12, and the insulating portion 13.

The mounting portion 11 has a tubular shape. The mounting portion 11 can have, for example, a cylindrical shape. The mounting portion 11 is provided on a side of the flange 14 opposite to a side on which heat radiating fins 16 are provided. The mounting portion 11 surrounds a loading portion 15.

An external dimension of the mounting portion 11 in a direction orthogonal to a center axis 1*a* of the vehicle lighting device 1 is smaller than an external dimension of the flange 14.

In addition, a convex portion 11*b* (corresponding to an example of a second convex portion) can be provided in an inside surface (inner wall) of the mounting portion 11. A concave portion 15*c* (corresponding to an example of a first concave portion) can be provided in a position of a side surface (outer wall) of the loading portion 15 corresponding to the convex portion 11*b*. The concave portion 15*c* is fitted to the convex portion 11*b*. That is, a shape and a dimension of the concave portion 15*c* are the same as a shape and a dimension of the convex portion 11*b*, and the convex portion 11*b* and the concave portion 15*c* are close contact with each other. Moreover, a concave portion (corresponding to an example of a second concave portion) is provided in an inside surface (inner wall) of the mounting portion 11 and a convex portion (corresponding to an example of a first convex portion) may be provided on the side surface (outer wall) of the loading portion 15.

Therefore, it is possible to increase release strength between the mounting portion 11 and the loading portion 15.

A convex portion 13*b* can be provided on an inside surface (inner wall) of the insulating portion 13. A concave portion 15*d* can be provided in a position of the side surface (outer wall) of the loading portion 15 corresponding to the convex portion 13*b*. The concave portion 15*d* is fitted to the convex portion 13*b*. That is, a shape and a dimension of the concave portion 15*d* are the same as a shape and a dimension of the convex portion 13*b*, and the convex portion 13*b* and the concave portion 15*d* are close contact with each other. Moreover, a concave portion is provided in the inside surface (inner wall) of the insulating portion 13 and a convex portion may be provided on the side surface (outer wall) of the loading portion 15.

Therefore, it is possible to increase release strength between the insulating portion 13 and the loading portion 15.

As described above, at least one of the concave portion 15*c* and the convex portion can be provided on the side surface (outer wall) of the loading portion 15. At least one of the convex portion 11*b* fitted to the concave portion 15*c* and the concave portion fitted to the convex portion provided on the side surface (outer wall) of the loading portion 15 can be provided in the mounting portion 11.

However, in a case where the mounting portion 11 having the tubular shape is formed of resin, rigidity thereof is lower than that of the loading portion 15. Therefore, if the concave portion is provided on the inside surface (inner wall) of the mounting portion 11, a thickness of the mounting portion 11 is thinned in a portion in which the concave portion is provided. Thus, there is a concern that cracks and the like are likely to occur in the portion in which the concave portion is provided.

Therefore, it is preferable that the convex portion 11*b* is provided on the inside surface (inner wall) of the mounting portion 11.

Here, for example, when the mounting portion 11 having the convex portion 11*b* and the loading portion 15 having the concave portion 15*c* are formed, and the loading portion 15 is inserted into the mounting portion 11, it is also contemplated that the convex portion 11*b* is fitted into the concave portion 15*c*. However, doing so, a height dimension (protrusion dimension) of the convex portion 11*b* (concave portion 15*c*) cannot be too long. In addition, a cross section shape of the convex portion 11*b* (concave portion 15*c*) is also limited to have an inclined surface and the like. Therefore, there is a concern that a certain limit occurs in a joint strength between the mounting portion 11 and the loading portion 15. In addition, if the convex portion 11*b* is fitted into the concave portion 15*c*, since a clearance is required between the mounting portion 11 and the loading portion 15, there is a concern that a backlash occurs.

Therefore, when manufacturing the vehicle lighting device 1, it is preferable that the socket 10 is formed by integrally molding the heat radiating portion 10*b* (loading portion 15) and the storage portion 10*a* (mounting portion 11). In this case, in a step of forming the socket 10, for example, the convex portion 11*b* fitted to the concave portion 15*c* is formed in the mounting portion 11.

For example, a step of forming the loading portion 15 in which at least one of the concave portion 15*c* and the convex portion is provided on the side surface, and a step of forming the socket 10 by integrally molding the loading portion 15 and the mounting portion 11 surrounding the side surface of the loading portion 15 may be provided.

In this case, in the step of forming the socket 10, at least one of the convex portion 11*b* fitted to the concave portion 15*c* and the concave portion fitted to the convex portion formed on the side surface of the loading portion 15 is formed in the mounting portion 11.

Integral molding can be performed, for example, using an insert molding method. Moreover, the storage portion 10*a* (mounting portion 11), the heat radiating portion 10*b* (loading portion 15), a power supply terminal 31 can be integrally molded using the insert molding method.

Therefore, since there is no limit in the height dimension and the cross section shape of the convex portion 11*b* (concave portion 15*c*), the joint strength between the mounting portion 11 and the loading portion 15 can be set within a desired range. In addition, it is possible to eliminate the backlash between the mounting portion 11 and the loading portion 15.

The bayonet 12 is provided on an outside surface (outer wall) of the mounting portion 11 and protrudes to the outside of the vehicle lighting device 1. The bayonet 12 faces the flange 14. A plurality of bayonets 12 are provided.

Figure 7:
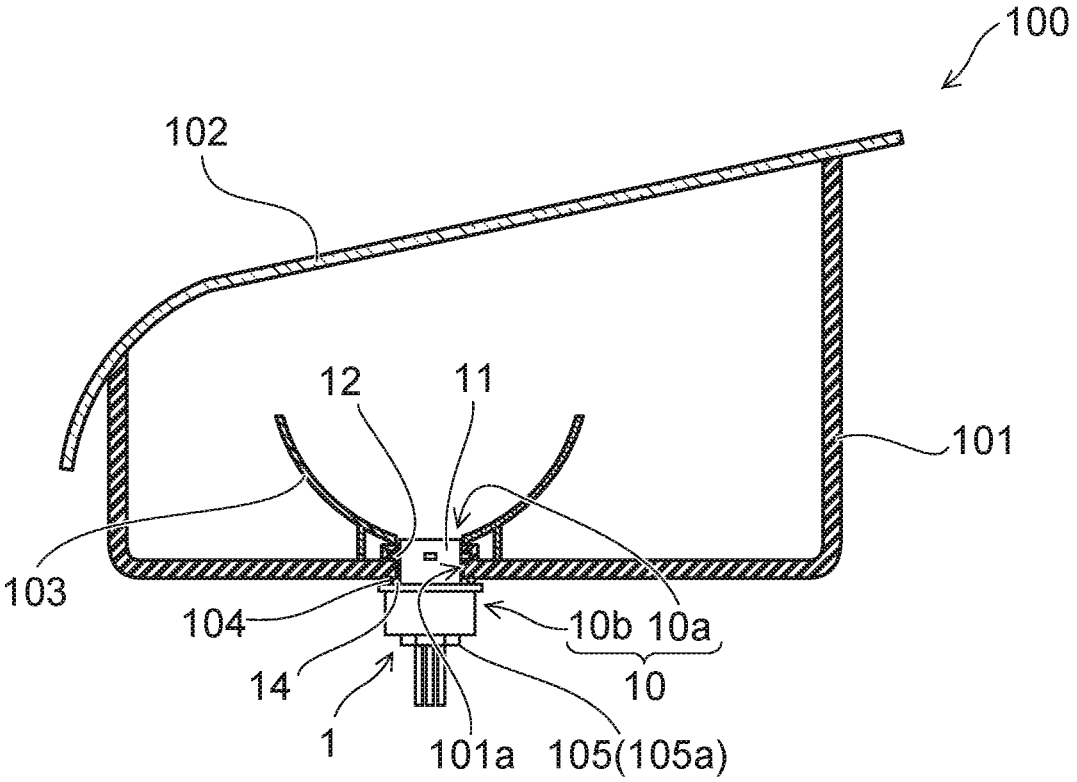
FIG. 7 is a schematic partial sectional view illustrating a vehicle lamp according to the embodiment.

When mounting the vehicle lighting device 1 on a housing 101, a portion of the mounting portion 11 in which the bayonets 12 are provided is inserted into an attachment hole 101*a* provided in the housing 101 (see FIG. 7). Then, when rotating the vehicle lighting device 1, the vehicle lighting device 1 is held in the housing 101. That is, the bayonets 12 are provided to be used in twist-lock.

The insulating portion 13 is provided on an inside of the mounting portion 11.

Figure 4A:
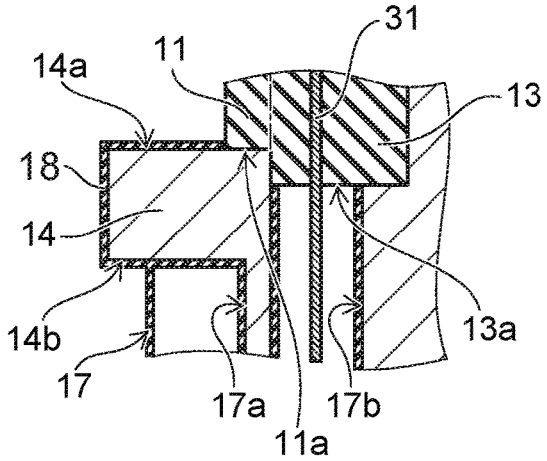
FIGS. 4A to 4D are schematic sectional views illustrating a position of an end surface of a mounting portion on a flange side and a position of an end surface of an insulating portion on the flange side.

Here, as illustrated in FIGS. 3 and 4A, the end surface 11*a* of the mounting portion 11 on the flange 14 side can be positioned on a surface 14*a* of the flange 14 on a side opposite to a side on which the heat radiating fins 16 are provided. The end surface 13*a* of the insulating portion 13 on the flange 14 side can be positioned on an inside of the flange 14.

Figure 4B:
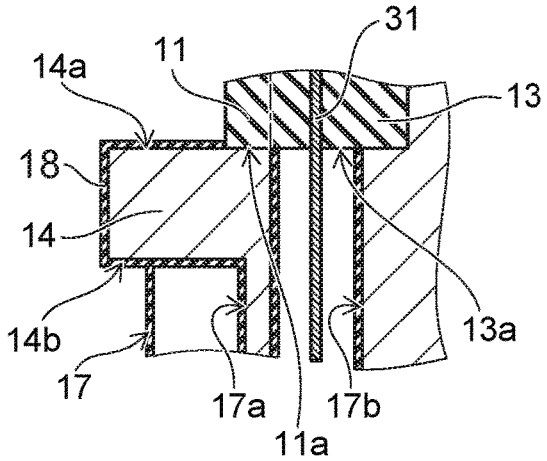

As illustrated in FIG. 4B, the end surface 11*a* of the mounting portion 11 on the flange 14 side can be positioned on the surface 14*a* of the flange 14. The end surface 13*a* of the insulating portion 13 on the flange 14 side can be positioned on the surface 14*a* of the flange 14.

Figure 4D:
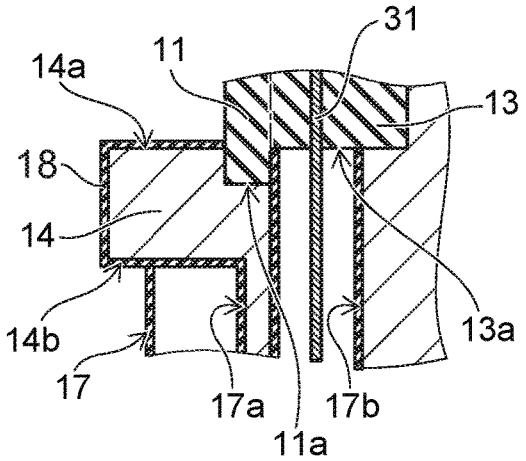
Figure 4C:
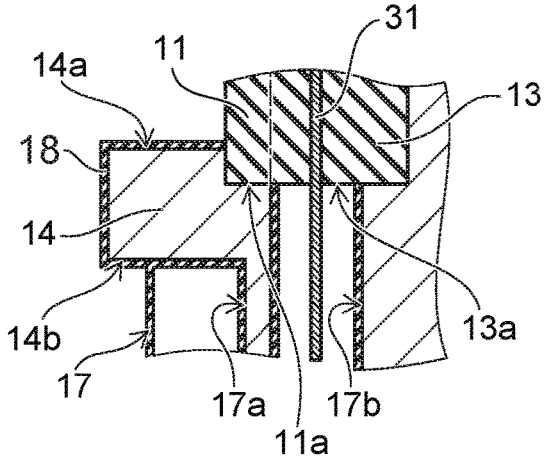

As illustrated in FIG. 4C, the end surface 11*a* of the mounting portion 11 on the flange 14 side can be positioned on the inside of the flange 14. The end surface 13*a* of the insulating portion 13 on the flange 14 side can be positioned on the inside of the flange 14.

As illustrated in FIG. 4D, the end surface 11*a* of the mounting portion 11 on the flange 14 side can be positioned on the inside of the flange 14. The end surface 13*a* of the insulating portion 13 on the flange 14 side can be positioned on the surface 14*a* of the flange 14.

In addition, a member (not illustrated) may be provided between the end surface 11*a* of the mounting portion 11 on the flange 14 side and the surface 14*a* of the flange 14. A member (not illustrated) may be provided between the end surface 13*a* of the insulating portion 13 on the flange 14 side and the surface 14*a* of the flange 14.

In addition, a protrusion portion protruding toward the mounting portion 11 and the insulating portion 13 can be provided in the surface 14*a* of the flange 14.

That is, the position of the end surface 11*a* of the mounting portion 11 on the flange 14 side and the position of the end surface 13*a* of the insulating portion 13 on the flange 14 side may be on the light emitting module 20 side more than the position of a surface 14*b* of the flange 14 on which the heat radiating fins 16 are provided.

The storage portion 10*a* can be formed by integrally molding the mounting portion 11, the bayonets 12, and the insulating portion 13 or can be formed by joining these members.

However, if the mounting portion 11, the bayonet 12, and the insulating portion 13 are integrally molded, it is possible to improve resistance against an external force and achieve reduction in manufacturing cost.

The storage portion 10*a* has a function of storing the light emitting module 20 and a function of insulating the power supply terminal 31. Therefore, it is preferable that the mounting portion 11, the bayonet 12, and the insulating portion 13 are formed of an insulating material. The insulating material can be, for example, an organic material such as resin, an inorganic material such as ceramics (for example, aluminum oxide, aluminum nitride, or the like), or the like.

In this case, it is also possible to form the storage portion 10*a* (mounting portion 11, the bayonet 12, and the insulating portion 13) from the insulating material having high thermal conductivity considering that heat generated in the light emitting module 20 is transmitted to the heat radiating portion 10*b*. The insulating material having high thermal conductivity can be, for example, ceramics (for example, aluminum oxide, aluminum nitride, or the like) and resin having high thermal conductivity. Resin having high thermal conductivity is obtained, for example, by mixing fibers or particles made of aluminum oxide having high thermal conductivity to resin such as PET, nylon, or the like.

Moreover, the mounting portion 11, the bayonet 12, and the insulating portion 13 can be also formed of a conductive material such as metal.

However, if these members are formed of the conductive material, it is necessary to provide a layer formed of the insulating material between the power supply terminal 31 and the insulating portion 13 or to form only the insulating portion 13 from the insulating material.

In addition, if the heat radiating portion 10*b* and the storage portion 10*a* are integrally molded, it is preferable that the storage portion 10*a* (mounting portion 11, the bayonet 12, and the insulating portion 13) is formed of resin.

The heat radiating portion 10*b* has the flange 14, the loading portion 15, the heat radiating fins 16, a convex portion 17, and a radiation layer 18.

The flange 14 has a plate shape. The flange 14 can have, for example, a disk shape. A distance between the side surface of the flange 14 and the center axis 1*a* of the vehicle lighting device 1 is longer than a distance between the side surface of the bayonet 12 and the center axis 1*a* of the vehicle lighting device 1. That is, the side surface of the flange 14 is positioned on the outside of the vehicle lighting device 1 more than the side surface of the bayonet 12.

In addition, a sealing member 104 is provided between the surface 14*a* of the flange 14 and the housing 101. Therefore, it is preferable that a surface roughness of the surface 14*a* of the flange 14 is small considering adhesion between the surface 14*a* of the flange 14 and the sealing member 104. On the other hand, when considering heat radiation property, it is preferable that the surface roughness of the heat radiating fins 16 is large. That is, the surface roughness of the surface 14*a* of the flange 14 is smaller than the surface roughness of the surfaces of the heat radiating fins 16. In this case, it is preferable that the surface roughness of the surface 14*a* of the flange 14 is made to be 5 μm or less in arithmetic average roughness Ra. In this case, for example, the heat radiating portion 10*b* is formed using a metal molding method, the surface 14*a* of the flange 14 is machined by cutting, and the heat radiating fins 16 may not be cut.

Therefore, it is possible to improve water tightness and the heat radiation property.

The loading portion 15 can have a tubular shape. The loading portion 15 is provided on the surface 14*a* of the flange 14 on a side opposite to the side on which the heat radiating fins 16 are provided. A concave portion 15*a* is provided on the side surface of the loading portion 15. The insulating portion 13 is provided on the inside of the concave portion 15*a*.

The light emitting module 20 is loaded on a surface 15*b* of the loading portion 15 on a side opposite to the flange 14 side.

The heat radiating fins 16 are provided on the surface 14*b* of the flange 14 on a side opposite to the side on which the loading portion 15 is provided. A plurality of heat radiating fins 16 can be provided. The plurality of heat radiating fins 16 can be provided to parallel to each other. The heat radiating fins 16 can have a plate shape.

Heat generated in the light emitting module 20 is transmitted to the heat radiating fins 16 via the loading portion 15 and the flange 14. Heat transmitted to the heat radiating fins 16 is discharged from the heat radiating fins 16 to the outside.

The convex portion 17 is provided on the surface 14*b* of the flange 14 in which the heat radiating fins 16 is provided. The convex portion 17 can have a block shape.

A concave portion 17*a* is provided on an outside surface of the convex portion 17. The concave portion 17*a* is opened on the outside surface of the convex portion 17.

A hole 17*b* is provided in the convex portion 17. The hole 17*b* penetrates between an end surface of the convex portion 17 on a side opposite to the flange 14 side and the surface 14*a* of the flange 14 on a side opposite to the side on which the heat radiating fins 16 are provided. An end portion of the power supply terminal 31 protrudes on the flange 14 side of the hole 17*b*. A part of the insulating portion 13 is exposed on the flange 14 side of the hole 17*b*. That is, an opening of the hole 17*b* on the flange 14 side is closed by the insulating portion 13. The hole 17*b* is not connected to the concave portion 17*a*.

A connector 105 having a sealing member 105*a* (corresponding to a first sealing member) is inserted into the hole 17*b*. Therefore, a cross section shape of the hole 17*b* is fitted to a cross section of the connector 105 having the sealing member 105*a*.

In addition, a cross section dimension of the hole 17*b* in a direction orthogonal to the center axis 1*a* of the vehicle lighting device 1 is slightly smaller than an external shape dimension of the sealing member 105*a* provided in a body of the connector 105. Therefore, when the connector 105 having the sealing member 105*a* is inserted into the hole 17*b*, the hole 17*b* is sealed to be water tightness.

The heat radiating portion 10*b* can be formed by integrally molding the flange 14, the loading portion 15, the heat radiating fins 16, and the convex portion 17 or can be formed by joining these members by individually forming these members.

However, if the flange 14, the loading portion 15, the heat radiating fins 16, and the convex portion 17 are integrally molded, it is possible to improve the heat radiation property, to improve resistance against an external force, to achieve reduction in manufacturing cost, and the like.

The heat radiating portion 10*b* has a function of loading the light emitting module 20 and a function of discharging heat generated in the light emitting module 20 to the outside.

Therefore, it is preferable that the flange 14, the loading portion 15, the heat radiating fins 16, and the convex portion 17 are formed of a material having high thermal conductivity. The material having high thermal conductivity can be metal such as aluminum and aluminum alloy, ceramics such as aluminum oxide and aluminum nitride, resin having high thermal conductivity, or the like.

In this case, the material of the storage portion 10*a* and the material of the heat radiating portion 10*b* can be different from each other. For example, the storage portion 10*a* is formed of the insulating material such as resin and the heat radiating portion 10*b* can be formed of the material having high thermal conductivity such as metal (for example, aluminum alloy and the like).

Here, the mounting portion 11 is provided on a side of the flange 14 opposite to the side on which the heat radiating fins 16 are provided. In addition, the mounting portion 11 surrounds the loading portion 15. However, the mounting portion 11 does not surround the flange 14, the heat radiating fins 16, and the convex portion 17.

Therefore, it is possible to efficiently discharge heat generated in the light emitting module 20 to the outside via the flange 14, the heat radiating fins 16, and the convex portion 17 which are formed of a material having high thermal conductivity. That is, it is possible to improve the heat radiation property of the vehicle lighting device 1.

In addition, the heat radiating portion 10*b* is joined to the storage portion 10*a*. The insulating portion 13 of the storage portion 10*a* is provided on the inside of the concave portion 15*a* of the heat radiating portion 10*b*. The loading portion 15 of the heat radiating portion 10*b* is provided on the inside of the mounting portion 11 of the storage portion 10*a*.

In this case, the storage portion 10*a* and the heat radiating portion 10*b* may be fitted into each other, or may be joined using adhesive and the like. The storage portion 10*a* and the heat radiating portion 10*b* may be joined by insert molding, or the storage portion 10*a* and the heat radiating portion 10*b* may be joined by heat welding.

Here, if the storage portion 10*a* and the heat radiating portion 10*b* are bonded, interface is formed between the storage portion 10*a* and the heat radiating portion 10*b*. In the interface is formed between the storage portion 10*a* and the heat radiating portion 10*b*, there is a concern that moisture enter from the interface. In this case, if the storage portion 10*a* and the heat radiating portion 10*b* are bonded and the like, it is possible to suppress entrance of moisture from the interface. However, it is difficult to completely sealing the interface.

In addition, in a case of the vehicle lighting device 1 provided in the automobile, a temperature of environment of use is −40° C. to 85° C. Therefore, even if initially it is water tightness, there is a concern that water tightness is lowered together with elapse of time by thermal stress generated by a difference in thermal expansion.

Thus, in the embodiment, the position of the end surface 11*a* of the mounting portion 11 on the flange 14 side and the position of the end surface 13*a* of the insulating portion 13 on the flange 14 side are on the light emitting module 20 side more than the position of the surface 14*b* of the flange 14.

In addition, an external dimension of the mounting portion 11 in a direction orthogonal to the center axis 1*a* of the vehicle lighting device 1 is smaller than an external dimension of the flange 14.

Therefore, as illustrated in FIG. 3, the interface between the mounting portion 11 and the flange 14 can be sealed by the sealing member 104 (corresponding to an example of a second sealing member).

Moreover, a part of the insulating portion 13 is exposed on the flange 14 side of the hole 17*b*. That is, the interface between the insulating portion 13 and the flange 14 is exposed on the inside of the hole 17*b*. However, the connector 105 having the sealing member 105*a* is inserted into the hole 17*b*. Therefore, when the connector 105 having the sealing member 105*a* is inserted into the hole 17*b*, the hole 17*b* is closed to be water tightness. As a result, it is possible to suppress that the moisture enters from the interface between the insulating portion 13 and the flange 14.

Moreover, the moisture is mainly on the outside of the housing 101 of a vehicle lamp 100. Therefore, moisture entering on the inside of the sealing member 104 from the inside of the housing 101 is little.

As described above, according to the vehicle lighting device 1 of the embodiment, it is possible to suppress that the moisture enters from the interface even if the storage portion 10*a* (mounting portion 11) and the heat radiating portion 10*b* (loading portion 15) are bonded.

The radiation layers 18 are provided on the surface of the flange 14, the surfaces of the heat radiating fins 16, and the surface of the convex portion 17. The radiation layer 18 contains metal oxide.

As described above, heat generated in the light emitting module 20 is mainly transmitted to the heat radiating fins 16 via the loading portion 15 and the flange 14. Heat transmitted to the heat radiating fins 16 is mainly discharged from the heat radiating fins 16 to the outside.

In addition, the heat radiating portion 10*b* (flange 14, the loading portion 15, the heat radiating fins 16, and the convex portion 17) may be formed of metal such as aluminum or aluminum alloy. The storage portion 10*a* may be formed of resin.

In this case, the thermal conductivity of metal is higher than the thermal conductivity of resin. Therefore, heat generated in the light emitting module 20 can be efficiently transmitted to the heat radiating fins 16. However, emissivity (emission ratio) of metal is considerably lower than emissivity of resin. For example, the emissivity of aluminum is approximately 0.09 and the emissivity of resin is approximately 0.6 to 0.85. Therefore, simply, if the heat radiating portion 10*b* is formed of metal, heat generated in the light emitting module 20 can be transmitted to the heat radiating fins 16, but there is a concern that heat is unlikely to be discharged from the heat radiating fins 16 to the atmosphere.

Here, emissivity of metal oxide is substantially equal to the emissivity of resin. For example, emissivity of iron oxide is approximately 0.79 to 0.9, emissivity of aluminum oxide is approximately 0.3 to 0.76, emissivity of nickel oxide is approximately 0.85 to 0.96, emissivity of zinc oxide is approximately 0.11 to 0.6, and emissivity of titanium oxide is approximately 0.35 to 0.6.

Therefore, in a case where the heat radiating portion 10*b* is formed of metal, it is preferable that the radiation layer 18 containing metal oxide is provided on the surface of the flange 14, the surfaces of the heat radiating fins 16, and the surface of the convex portion 17. The radiation layer 18 containing metal oxide can be formed using, for example, a deposition method such as a sputtering method, anodizing, and the like. For example, it is possible to form the radiation layer 18 (anodized film layer: film of aluminum oxide) on the surface of the heat radiating portion 10*b* which is formed of aluminum or aluminum alloy by performing anodizing.

In addition, metal oxide can be an oxide of metal contained in the flange 14, the heat radiating fins 16, and the like. Therefore, it is possible to form the radiation layer 18 by oxidizing the surface of the flange 14, the surfaces of the heat radiating fins 16, and the like. Therefore, it is possible to improve productivity and to achieve reduction in production cost.

For example, in a case where metal contained in the flange 14, the heat radiating fins 16, and the like is aluminum or aluminum alloy, metal oxide can be an oxide of aluminum. Therefore, it is possible to easily form the radiation layer 18 formed of aluminum oxide by anodizing the flange 14, the heat radiating fins 16, and the like. Therefore, it is possible to improve productivity and to achieve reduction in production cost.

Meanwhile, the thermal conductivity of metal oxide is significantly lower than the thermal conductivity of metal. For example, the thermal conductivity of aluminum is approximately 204 W/(m·k), the thermal conductivity of aluminum oxide is approximately 60 W/(m·k) to 70 W/(m·k). Therefore, if the radiation layer 18 containing metal oxide is provided in a transmitting path of heat, there is a concern that heat conduction is inhibited.

In this case, the radiation layer 18 cannot be provided on the surface of the loading portion 15. Therefore, since the radiation layer 18 containing metal oxide is not provided between an end surface 15*b* of the loading portion 15 and the light emitting module 20, it is possible to efficiently transmit heat generated in the light emitting module 20 to the heat radiating fins 16. In addition, heat generated in the light emitting module 20 is easily transmitted to the outside via the mounting portion 11.

In addition, the radiation layer 18 cannot be provided on a surface of the loading portion 15 facing the mounting portion 11, a surface of the flange 14 facing the mounting portion 11, and in a region of the end surface 15*b* of the loading portion 15 in which the light emitting module 20 is provided. In addition, the radiation layer 18 can be provided in regions other than the region of the end surface 15*b* of the loading portion 15 in which the light emitting module 20 is provided.

If the radiation layer 18 is not provided on the surface of the loading portion 15 facing the mounting portion 11 and the surface of the flange 14 facing the mounting portion 11, heat generated in the light emitting module 20 is easily transmitted to the outside via the mounting portion 11. In addition, if the radiation layer 18 is not provided in the region of the end surface 15*b* of the loading portion 15 in which the light emitting module 20 is provided, it is possible to efficiently transmit heat generated in the light emitting module 20 to the heat radiating fins 16.

In addition, if the radiation layer 18 is provided in the regions other than the region of the end surface 15*b* of the loading portion 15 in which the light emitting module 20 is provided, heat is easily discharged from the end surface 15*b* of the loading portion 15.

Moreover, when forming the radiation layer 18, the radiation layer 18 cannot be formed in the regions by masking desired regions.

As illustrated in FIGS. 1 and 3, the light emitting module 20 is provided on the surface 15*b* of the loading portion 15 on the side opposite to the flange 14 side.

The light emitting module 20 has a substrate 21, a light emitting element 22, a control element 23, and a control element 24.

The substrate 21 is provided on the surface 15*b* of the loading portion 15. The substrate 21 has a plate shape. A wiring pattern is provided on the surface of the substrate 21. A material or a structure of the substrate 21 is not particularly limited. For example, the substrate 21 can be formed of an inorganic material such as ceramics (for example, aluminum oxide, aluminum nitride, and the like), an organic material such as paper phenol and glass epoxy, and the like. In addition, the substrate 21 may be obtained by coating a surface of a metal plate with an insulating material. Moreover, in a case where the surface of the metal plate is coated with the insulating material, the insulating material may be formed of an organic material or may be formed of an inorganic material.

If a heating value of the light emitting element 22 is large, it is preferable that the substrate 21 is formed by using a material having high thermal conductivity in terms of heat radiation. As the material having high thermal conductivity, ceramics such as aluminum oxide or aluminum nitride, a material that is obtained by coating a surface of a metal plate with an insulating material, and the like can be exemplified. In addition, the substrate 21 may be a single layer or may be a multi-layer.

The light emitting element 22 is provided on the substrate 21. The light emitting element 22 is electrically connected to the wiring pattern provided on the surface of the substrate 21. The light emitting element 22 can be, for example, a light emitting diode, an organic light emitting diode, a laser diode, and the like.

A form of the light emitting element 22 is not particularly limited.

The light emitting element 22 can be a light emitting element of a surface mounting type such as Plastic Leaded Chip Carrier (PLCC) type. Moreover, the light emitting element 22 illustrated in FIGS. 1 and 3 is the light emitting element of the surface mounting type.

The light emitting element 22 can be, for example, a light emitting element having a lead wire of a shell type and the like.

In addition, the light emitting element 22 can be mounted by Chip On Board (COB). In a case of the light emitting element 22 that is mounted by the COB, it is possible to provide the light emitting element 22 of a chip shape, wiring electrically connecting the light emitting element 22 and the wiring pattern, a frame-like member surrounding the light emitting element 22 and the wiring, a sealing portion provided on an inside of the frame-like member, and the like on the substrate 21.

In this case, the sealing portion can include a phosphor. The phosphor can be, for example, a YAG-based phosphor (yttrium-aluminum-garnet fluorescent material). For example, if the light emitting element 22 is a blue emitting diode and the phosphor is the YAG-based phosphor, the YAG-based phosphor is excited by blue light emitted from the light emitting element 22 and yellow fluorescence is emitted from the YAG-based phosphor. Then, white light is emitted from the vehicle lighting device 1 by mixing blue light and yellow light. Moreover, types of the phosphors and types of the light emitting elements 22 are not limited to the examples described above. The types of the phosphors and the types of the light emitting elements 22 can be appropriately changed such that a desired emitting color is obtained in accordance with the application of the vehicle lighting device 1 and the like.

An upper surface of the light emitting element 22 that is a light emitting surface faces a front side of the vehicle lighting device 1 and mainly emits light on the front side of the vehicle lighting device 1. The number, sizes, and arrangements of the light emitting elements 22 are not limited to the examples described above, and can be appropriately changed in accordance with the size and the application of the vehicle lighting device 1, and the like.

The control element 23 is provided on the substrate 21. The control element 23 is electrically connected to the wiring pattern provided on the surface of the substrate 21. The control element 23 can control, for example, a current flowing through the light emitting element 22.

Since there are variations in forward voltage characteristics of the light emitting element 22, if an applied voltage between an anode terminal and a ground terminal is constant, variations occur in brightness (light flux, luminance, luminous intensity, and illuminance) of the light emitting element 22. Therefore, a value of the current flowing through the light emitting element 22 is made to fall within a predetermined range by the control element 23 so that the brightness of the light emitting element 22 falls within a predetermined range.

The control element 23 can be, for example, a resistor. The control element 23 can be, for example, a resistor of a surface mounting type, a resistor (metal oxide film resistor) having a lead wire, a film-like resistor formed using a screen printing method, and the like. Moreover, the control element 23 illustrated in FIGS. 1 and 3 is the resistor of the surface mounting type.

In this case, the value of the current flowing through the light emitting element 22 can be within a predetermined range by changing a resistance value of the control element 23.

For example, in a case where the control element 23 is the film-like resistor, a part of the control element 23 is removed for a plurality of control elements 23 and a removed portion (not illustrated) is formed in each of the control elements 23. Then, the resistance value is changed for the plurality of control elements 23 by a size of the removed portion and the like. In this case, if a part of the control elements 23 is removed, the resistance value is increased. Removing of a part of the control elements 23 can be performed, for example, by applying laser light to the control element 23.

The number, sizes, and arrangements of the control elements 23 are not limited to the examples described above, and can be appropriately changed in accordance with the number and a specification of the light emitting element 22, and the like.

The control element 24 is provided on the substrate 21. The control element 24 is electrically connected to the wiring pattern provided on the surface of the substrate 21. The control element 24 is provided so as not to apply a reverse voltage to the light emitting element 22 and not to apply pulse noise from the opposite direction to the light emitting element 22.

The control element 24 can be, for example, a diode. The control element 24 can be, for example, a diode of a surface mounting type, a diode having a lead wire, and the like. Moreover, the control element 24 illustrated in FIG. 1 is the diode of the surface mounting type.

In addition, it is also possible to provide a pull-down resistor to detect disconnection of the light emitting element 22, to prevent erroneous lighting, and the like. In addition, it is also possible to provide a cover portion for covering the wiring pattern, the film-like resistor, and the like. The cover portion can include, for example, a glass material.

The power supplying portion 30 has a plurality of power supply terminals 31. The plurality of power supply terminals 31 can be provided in parallel in a predetermined direction. The plurality of power supply terminals 31 are provided on the inside of the socket 10 (insulating portion 13). The plurality of power supply terminals 31 extend on the inside of the insulating portion 13. One-side end of the plurality of power supply terminals 31 is electrically connected to the light emitting module 20. One-side end of the plurality of power supply terminals 31 protrudes from an end surface of the insulating portion 13 on a side opposite to the flange 14 side and is electrically connected to the wiring pattern provided in the substrate 21. The other end of the plurality of power supply terminals 31 protrudes from the end surface 13*a* of the insulating portion 13 on the flange 14 side. The other end of the plurality of power supply terminals 31 is exposed on the inside of the hole 17*b*.

The number and a shape of the power supply terminals 31, and the like are not limited to the examples described above, and can be appropriately changed.

In addition, the power supplying portion 30 can include a substrate (not illustrated), circuit components (for example, capacitors, resistors, and the like), and the like. Moreover, the substrate (not illustrated), the circuit components, and the like can be provided on the inside of the storage portion 10*a*, the inside of the heat radiating portion 10*b*, and the like.

Next, a convex portion 11*b* of another embodiment will be further described.

In a case where a socket 10 is formed by integrally molding a heat radiating portion 10*b* (loading portion 15) and a storage portion 10*a* (mounting portion 11), a convex portion 11*b* and a concave portion 15*c* are simultaneously formed. Then, hereinafter, the convex portion 11*b* will be described. That is, the concave portion 15*c* may be similar to the convex portion 11*b*. In addition, a case where concave portions are provided on an inside surface (inner wall) of the mounting portion 11 and an inside surface (inner wall) of an insulating portion 13, and a convex portion is provided on a side surface (outer wall) of the loading portion 15 are also similar.

Figure 5A:
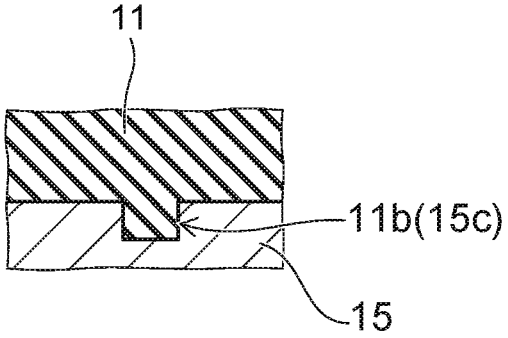
FIGS. 5A to 5C are schematic sectional view illustrating a cross section shape of a convex portion according to another embodiment.
Figure 5B:
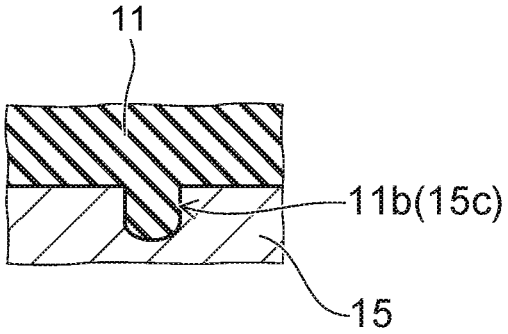
Figure 5C:
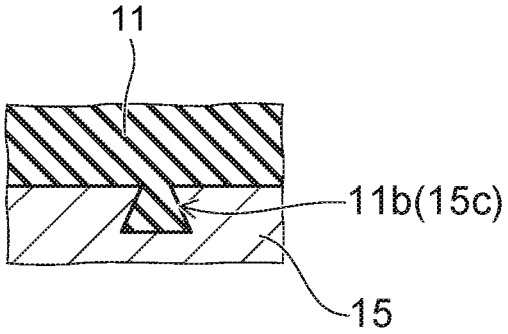

FIGS. 5A to 5C are schematic sectional view illustrating a cross sect shape of the convex portion 11*b* according to another embodiment.

As illustrated in FIG. 5A, the cross sect shape of the convex portion 11*b* can be rectangular. Therefore, it is possible to improve a joint strength.

As illustrated in FIG. 5B, the cross sect shape of the convex portion 11*b* can be a shape of which at least a tip is curved. Moreover, the cross sect shape of the convex portion 11*b* can also be, for example, semi-circular or semi-elliptical. Therefore, it is possible to suppress occurrence of cracks due to thermal shock generated when a temperature of environment of use is rapidly changed.

As illustrated in FIG. 5C, the cross sect shape of the convex portion 11*b* can be a trapezoid. In this case, an upper base of the trapezoid can be an interface between the mounting portion 11 and the loading portion 15. Therefore, it is possible to further improve the joint strength.

In addition, the convex portion 11*b* is continuously provided, for example, on the inside surface (inner wall) of the mounting portion 11 and the inside surface (inner wall) of the insulating portion 13. For example, the convex portion 11*b* can be continuously provided around the center axis 1*a* of the vehicle lighting device 1. That is, the convex portion 11*b* can have an annular shape. Moreover, the socket 10 illustrated in FIG. 3, one circular-shaped convex portion 11*b* may be provided.

In addition, the convex portion 11*b* can have, for example, a protruding shape. In this case, a length of the protruding convex portion 11*b* around the center axis 1*a* of the vehicle lighting device 1 can be appropriately changed. For example, the protruding convex portion 11*b* may have a predetermined length (island) around the center axis 1*a* of the vehicle lighting device 1 or may also be point-like (columnar).

The number of the protruding convex portions 11*b* may be one or may be a plurality. The plurality of protruding convex portions 11*b* can be provided in a state of being spaced around the center axis 1*a* of the vehicle lighting device 1. In this case, distances between the plurality of convex portions 11*b* may be equal or may be different. Cross sect shapes or cross sect dimensions of the plurality of convex portions 11*b* may be equal or may be different.

The convex portions 11*b* can be provided in plurality in a state of being spaced in the direction of the center axis 1*a* of the vehicle lighting device 1.

Figure 6A:
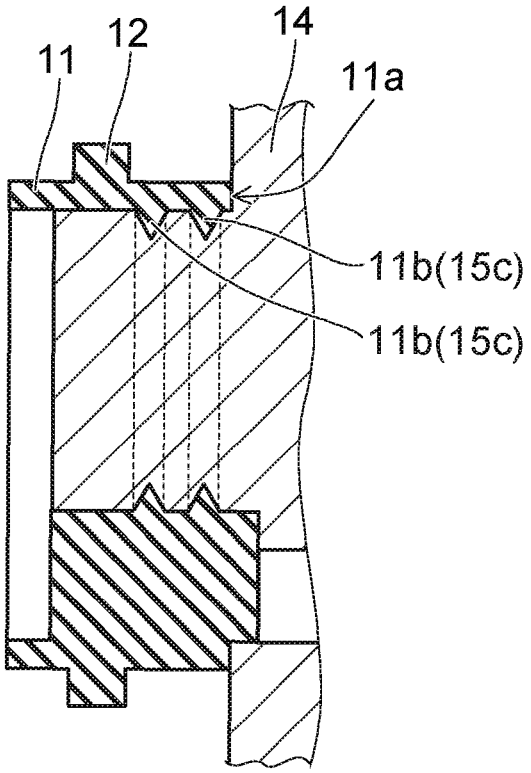
FIGS. 6A and 6B are schematic sectional views illustrating convex portions are provided in plurality in a state of being spaced in a direction of a center axis of the vehicle lighting device. Moreover.
Figure 6B:
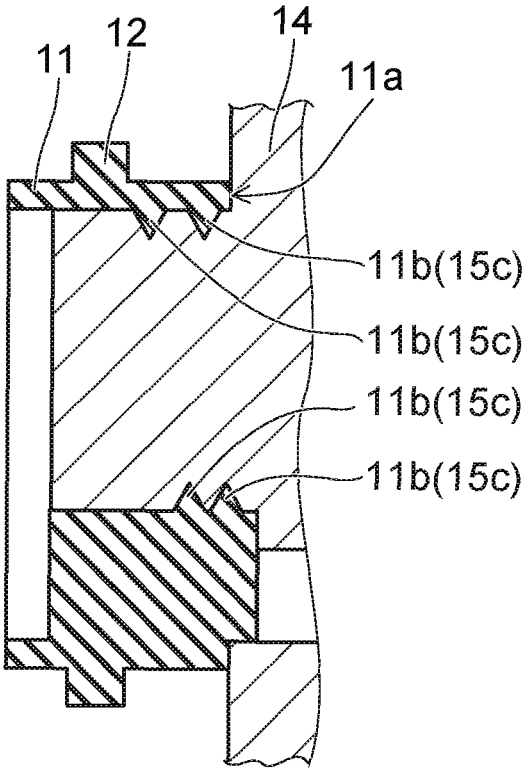

FIGS. 6A and 6B are schematic sectional views illustrating the convex portions 11*b* are provided in plurality in a state of being spaced in the direction of the center axis 1*a* of the vehicle lighting device 1. Moreover, FIG. 6A is a sectional view of a case of an annular convex portion 11*b* and FIG. 6B is a sectional view of a case of a protruding convex portion 11*b*.

As illustrated in FIGS. 6A and 6B, one convex portion 11*b* is provided in the vicinity of the end surface 11*a* of the mounting portion 11 on the flange 14 side and the other convex portion 11*b* is provided in the vicinity of the bayonet 12.

The mounting portion 11 may be deformed in a direction orthogonal to the center axis 1*a* of the vehicle lighting device 1 due to aging and the like. For example, the mounting portion 11 may be deformed so that a dimension of the mounting portion 11 is lengthened in the direction orthogonal to the center axis 1*a* of the vehicle lighting device 1. If the deformation of the mounting portion 11 is large, there is a concern that a backlash is generated between the mounting portion 11 and the loading portion 15 or the joint strength is lowered. In this case, as illustrated in FIG. 3, the housing 101 of the vehicle lamp 100 is provided between the bayonet 12 and the flange 14. Therefore, the deformation of the mounting portion 11 is suppressed by the housing 101.

Then, in the embodiment, the convex portion 11*b* is provided in a position between the bayonet 12 and the flange 14 in the direction of the center axis 1*a* of the vehicle lighting device 1. Therefore, it is possible to maintain adhesion between the convex portion 11*b* and the concave portion 15*c*.

In addition, as illustrated in FIG. 6B, in a case where the protruding convex portions 11*b* are provided in plurality, positions (distances from the end surface 11*a*) thereof in the direction of the center axis 1*a* of the vehicle lighting device 1 may be equal or may be different.

Next, the vehicle lamp 100 of the embodiment is exemplified.

Moreover, hereinafter, as an example, a case of a front combination light in which the vehicle lamp 100 is provided in the automobile will be described. However, the vehicle lamp 100 is not limited to the front combination light provided in the automobile. The vehicle lamp 100 may be a vehicle lamp provided in an automobile, a railway vehicle, and the like.

FIG. 7 is a schematic partial sectional view illustrating the vehicle lamp 100 according to the embodiment.

As illustrated in FIG. 7, the vehicle lighting device 1, the housing 101, a cover 102, an optical element portion 103, the sealing member 104, and the connector 105 are provided in the vehicle lamp 100.

The housing 101 has a box shape of which one end portion is opened. The housing 101 can be formed of, for example, resin and the like through which light is not transmitted.

An attachment hole 101*a* into which a portion of the mounting portion 11 in which the bayonet 12 is provided is inserted is provided in a bottom surface of the housing 101. Concave portions into which the bayonets 12 provided in the mounting portion 11 are inserted are provided in a periphery of the attachment hole 101*a*. Moreover, a case the attachment hole 101*a* is directly provided in the housing 101 is exemplified, but an attaching member having the attachment hole 101*a* may be provided in the housing 101.

When attaching the vehicle lighting device 1 to the vehicle lamp 100, portions of the mounting portion 11 in which the bayonets 12 are provided are inserted into the attachment hole 101*a* and the vehicle lighting device 1 is rotated. Then, the bayonets 12 are held by the concave portions provided on the periphery of the attachment hole 101*a*. Such a mounting method is called a twist-lock.

The cover 102 is provided so as to close an opening of the housing 101. The cover 102 can be formed of resin and the like having a light-transmitting property. The cover 102 can have functions of a lens and the like.

Light emitted from the vehicle lighting device 1 is incident on the optical element portion 103. The optical element portion 103 performs reflection, diffusion, guiding, and condensing of the light emitted from the vehicle lighting device 1, formation of a predetermined light distribution pattern, and the like. For example, the optical element portion 103 illustrated in FIG. 7 is a reflector. In this case, the optical element portion 103 reflects the light emitted from the vehicle lighting device 1, and causes the predetermined light distribution pattern to be formed. If the optical element portion 103 is the reflector, the optical element portion 103 is provided on the inside of the housing 101 so as to be coaxially with the center axis of the attachment hole 101*a*.

The sealing member 104 is provided between the flange 14 and the housing 101. The sealing member 104 can have an annular shape. The sealing member 104 can be formed of a material having elasticity such as rubber or silicone resin.

When mounting the vehicle lighting device 1 to the vehicle lamp 100, the sealing member 104 is interposed between the flange 14 and the housing 101. Thus, an inside space of the housing 101 is closed by the sealing member 104. In addition, as described above, the interface between the mounting portion 11 and the flange 14 is sealed by the sealing member 104. In addition, the bayonets 12 are pressed against the housing 101 by elastic force of the sealing member 104. Thus, the vehicle lighting device 1 can be suppressed to be separated from the housing 101.

The connectors 105 are fitted into end portions of the plurality of power supply terminals 31 exposed on the inside of the hole 17*b*. Power supply (not illustrated) and the like are electrically connected to the connectors 105. Therefore, power supply (not illustrated) and the like are electrically connected to the light emitting elements 22 by fitting the connectors 105 into the end portions of the power supply terminals 31. In addition, the connectors 105 have stepped portions. Then, the sealing member 105*a* is attached to the stepped portions (see FIG. 3). The sealing member 105*a* is provided to prevent entrance of water on the inside of the hole 17*b*. When the connector 105 having the sealing member 105*a* is inserted into the hole 17*b*, the hole 17*b* is sealed to be water tightness.

The sealing member 105*a* can have an annular shape. The sealing member 105*a* can be formed of a material having elasticity such as rubber or silicone resin. The connector 105 can also be joined to an element on the socket 10 side using adhesive or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A vehicle lighting device comprising:

a heat radiating portion that has a flange having a plate shape, heat radiating fins provided on one surface of the flange, and a loading portion provided on a surface of the flange on a side opposite to the side on which the heat radiating fins are provided;

a storage portion that is provided on a side of the flange opposite to the side on which the heat radiating fins are provided, has a mounting portion surrounding a side surface of the loading portion and bayonets provided on a side surface of the mounting portion, and is formed of a material different from a material of the heat radiating portion; and a light emitting module that is provided on an end surface of the loading portion on a side opposite to the flange side and has a light emitting element, wherein at least one of a first concave portion and a first convex portion is provided on the side surface of the loading portion, and wherein at least one of a second convex portion fitted to the first concave portion and a second concave portion fitted to the first convex portion is provided on the mounting portion.

2. The device according to claim 1, wherein a position of an end surface of the mounting portion on the flange side is on the surface of the flange or inside the flange.

3. The device according to claim 1, further comprising:

radiation layers that are provided on the surface of the flange and the surface of the heat radiating fins, and include a metal oxide, wherein the flange, the heat radiating fins, and the loading portion include a metal, and the mounting portion includes a resin.

4. The device according to claim 3, wherein the radiation layer is not provided on the surface of the loading portion.

5. The device according to claim 3, wherein the radiation layer is not provided on a side surface of the loading portion, a region on a surface of the flange on which the loading portion is provided, and a region of the end surface of the loading portion in which the light emitting module is provided, and wherein the radiation layer is provided in a region other than the region of the end surface of the loading portion in which the light emitting module is provided.

6. The device according to claim 3, wherein the metal oxide is an oxide of the metal.

7. The device according to claim 3, wherein the metal is aluminum or an aluminum alloy, and the metal oxide is aluminum oxide.

8. The device according to claim 1, wherein a surface roughness of the surface of the flange on the loading portion side is smaller than a surface roughness of a surface of the heat radiating fin.

9. The device according to claim 1, wherein the first concave portion is continuously provided around a center axis of the vehicle lighting device.

10. The device according to claim 1, wherein the first convex portion is continuously provided around a center axis of the vehicle lighting device.

11. The device according to claim 1, wherein a plurality of first concave portions are provided in a state of being spaced around a center axis of the vehicle lighting device.

12. The device according to claim 1, wherein a plurality of first convex portions are provided in a state of being spaced around a center axis of the vehicle lighting device.

13. The device according to claim 1, wherein a plurality of first concave portions are provided in a state of being spaced in a direction of a center axis of the vehicle lighting device.

14. The device according to claim 1, wherein a plurality of first convex portions are provided in a state of being spaced in a direction of a center axis of the vehicle lighting device.

15. The device according to claim 1, wherein an external dimension of the mounting portion in a direction orthogonal to a center axis of the vehicle lighting device is smaller than an external dimension of the flange.

16. The device according to claim 1, further comprising:

a power supplying terminal of which one end is electrically connected to the light emitting module, wherein the heat radiating portion further includes a convex portion provided on the surface of the flange on which the heat radiating fins are provided, and the convex portion has a hole in which the other end of the power supplying terminal is exposed.

17. The device according to claim 16, wherein the hole is sealed by a first sealing member provided in a connector that is fitted to the other end of the power supplying terminal.

18. A vehicle lamp comprising:

the vehicle lighting device according to claim 1;

a housing that has a hole into which a portion of a mounting portion in which bayonets are provided is inserted; and a second sealing member that is provided between the housing and a flange.

* * * * *